US007595763B2

(12) United States Patent
Hershey et al.

(10) Patent No.: US 7,595,763 B2
(45) Date of Patent: Sep. 29, 2009

(54) WIRELESS DEVICE HAVING MOVABLE ANTENNA ASSEMBLY AND SYSTEM AND METHOD FOR PROCESS MONITORING

(75) Inventors: George Hershey, Blue Bell, PA (US); Mark Striano, Horsham, PA (US); Roger Hoover, Leesport, PA (US); Larry Hain, Chalfont, PA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/967,685

(22) Filed: Dec. 31, 2007

(65) Prior Publication Data

US 2009/0167613 A1 Jul. 2, 2009

(51) Int. Cl.
*H01Q 3/00* (2006.01)

(52) U.S. Cl. ..... 343/757; 343/882; 343/872; 343/878

(58) Field of Classification Search ..... 343/702, 343/715, 757, 872, 878, 880, 882
See application file for complete search history.

(56) References Cited

U.S. PATENT DOCUMENTS 7,057,577 B1 * 6/2006 Willoughby et al. ..... 343/906
2003/0142033 A1 * 7/2003 Pepperling et al. ..... 343/878
2004/0066348 A1 * 4/2004 Janitch et al. ..... 343/785
2006/0012534 A1 * 1/2006 Duncan et al. ..... 343/715

* cited by examiner

*Primary Examiner*—James H. Cho
*Assistant Examiner*—Jany Tran
(74) *Attorney, Agent, or Firm*—Patents On Demand, P.A.; Neil R. Jetter

(57) ABSTRACT

A wireless device (150) and related method of monitoring or controlling a process includes a housing (200) having a mounting structure (300) for rigidly connecting the wireless device with respect to a solid surface, such as within a processing facility (125). An antenna assembly (250) has a movable connection (e.g., using set screw 310 and channel 425) with the housing (200), wherein the antenna assembly can be moved with respect to the housing (200), and wherein the movable connection maintains a hermetic seal and an explosion-proof flame path of the housing and the antenna assembly. The wireless device (150) can include a transmitter, receiver or a transceiver coupled to the antenna assembly (250), wherein the wireless device (150) is operable to wirelessly transmit using the antenna assembly to a remote receiver or receive information from a remotely located transmitter.

14 Claims, 11 Drawing Sheets

WIRELESS DEVICE HAVING MOVABLE ANTENNA ASSEMBLY AND SYSTEM AND METHOD FOR PROCESS MONITORING

FIELD OF THE INVENTION

This disclosure relates generally to control or monitoring systems, and more specifically to a system and method of wireless monitoring or control.

BACKGROUND

Processing facilities, such as manufacturing plants, chemical plants and oil refineries, are typically managed using process control systems. Valves, pumps, motors, heating/cooling devices, and other industrial equipment typically perform actions needed to process materials in the processing facilities. Among other functions, the process control systems often manage the use of the industrial equipment in the processing facilities.

In conventional process control systems, controllers are often used to control the operation of the industrial equipment in the processing facilities. The controllers can typically monitor the operation of the industrial equipment and/or the products or related materials through use of various sensors, and provide control signals to the industrial equipment based on information retrieved from the various sensors. However, control steps are often highly dependent upon measured or otherwise sensed data from the sensors, and inaccuracies or delays in receipt of the data can have a significant effect on the ability to control the process.

Wireless transmitters can be used with sensors to provide data from the processing facility to a remotely located processor for evaluation of the data. The wireless transmitters are generally rigidly connected to various processing devices to ensure the capture of the desired data. Under certain arrangements (e.g. structures and the like in the path of transmission) or environmental conditions, for a given transmitted power level the signal strength of the data signal received at the processor or other remote receiver can be or become insufficient for accurate evaluation of the data required for proper control. Moreover, in certain applications it may not be possible to increase the transmitted power level to compensate for poor received signal strength.

Accordingly, there is a need for a system and method for monitoring with a wireless transmitter that provides for accurate and timely transmission of data to a remote receiver. There is a further need for such a system and method that facilitates use of the monitoring system, such as positioning in difficult to reach locations. There is yet a further need for such a system and method that provides received transmissions with improved signal strength for a given transmitted power level.

SUMMARY

The Summary is provided to comply with 37 C.F.R. §1.73, requiring a summary of the invention briefly indicating the nature and substance of the invention. It is submitted with the understanding that it will not be used to interpret or limit the scope or meaning of the claims.

In one exemplary embodiment of the present disclosure, a wireless device comprises a housing having a mounting structure for rigidly connecting the wireless device with respect to a solid surface, and an antenna assembly having a movable connection with the housing. The antenna assembly can be moved with respect to the housing, and wherein the movable connection maintains a hermetic seal and an explosion-proof flame path of the housing and the antenna assembly. A transmitter, a receiver, or a transceiver is coupled to the antenna assembly, wherein the wireless device is operable to wirelessly transmit using the antenna assembly to a remote receiver or receive information from a remotely located transmitter.

As used herein, the term "transceiver" refers to a device that has both a transmitter and a receiver which share a single common housing. The transmitter and receiver in the transceiver may or may not share common circuitry.

In one exemplary embodiment of the present disclosure, a wireless device having a movable antenna assembly can be operably coupled to a sensing device that is operable to capture data representative of one or more parameters of a process device or sample. Since the movable antenna assembly antenna can be used for both transmitting and receiving, the wireless device can be a transmitter, receiver, or a transceiver. The wireless device can have a housing with a mounting structure for rigidly connecting the wireless device with respect to the process device or sample, and an antenna assembly having a movable connection with the housing. The antenna assembly can be moved with respect to the housing. The movable connection can maintain a hermetic seal and an explosion-proof flame path of the housing and the antenna assembly. In one embodiment the wireless device is a wireless transmitter or transceiver which wirelessly transmits the sensor data using the antenna assembly to a remote receiver.

In another exemplary embodiment, a wireless monitoring system for a process device or sample can include a sensing device, and wireless transmitter and a wireless receiver. The sensing device can capture data representative of one or more parameters of the process device or sample. In one embodiment, the wireless device comprises a transmitter, receiver or transceiver operably coupled to the sensing device, the wireless device having a housing and an antenna assembly. The housing can have a mounting structure for connecting the wireless device in proximity to the process device or sample, and the antenna assembly can have a movable connection with the housing. The antenna assembly can be moved with respect to the housing, and the movable connection can maintain a hermetic seal and an explosion-proof flame path of the housing and the antenna assembly. In one embodiment, the receiver can be remotely positioned from a wireless transmitter or transceiver according to an embodiment of the invention, and the transmitter or transceiver can wirelessly transmit the data using the antenna assembly to a remote receiver.

In a further exemplary embodiment, a method of monitoring a process device or sample can involve providing a wireless transmitter or transceiver having an antenna assembly and a housing; adjusting a position of the antenna assembly with respect to the housing while maintaining a hermetic seal and an explosion-proof flame path of the housing and the antenna assembly; measuring a signal strength of a signal transmitted by the wireless transmitter at a remotely located receiver, and determining a target position of the antenna assembly with respect to the housing based at least in part on the signal strength.

The technical effect includes, but is not limited to, improving monitoring of process or sample parameters by providing more robust wireless data transmissions and/or data reception. The technical effect further includes, but is not limited to, maintaining the quality of the data by maintaining a hermetic seal and explosion-proof flame path of the transmitting device.

The above-described and other features and advantages of the present disclosure will be appreciated and understood by those skilled in the art from the following detailed description, drawings, and appended claims.

DETAILED DESCRIPTION OF THE INVENTION

Figure 1:
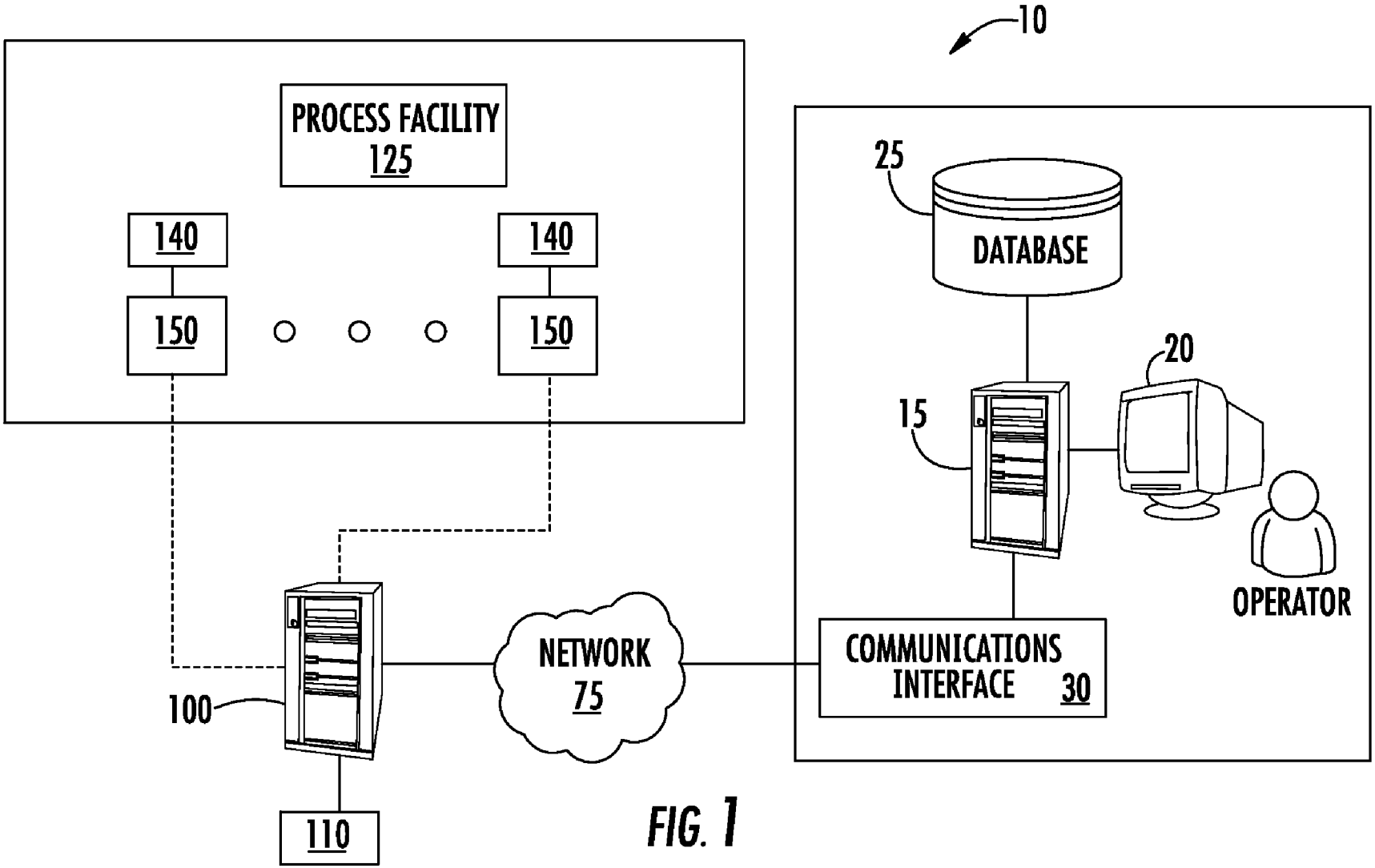
FIG. 1 is a schematic illustration of a monitoring system using a wireless device according to an exemplary embodiment of the present invention.
Figure 2:
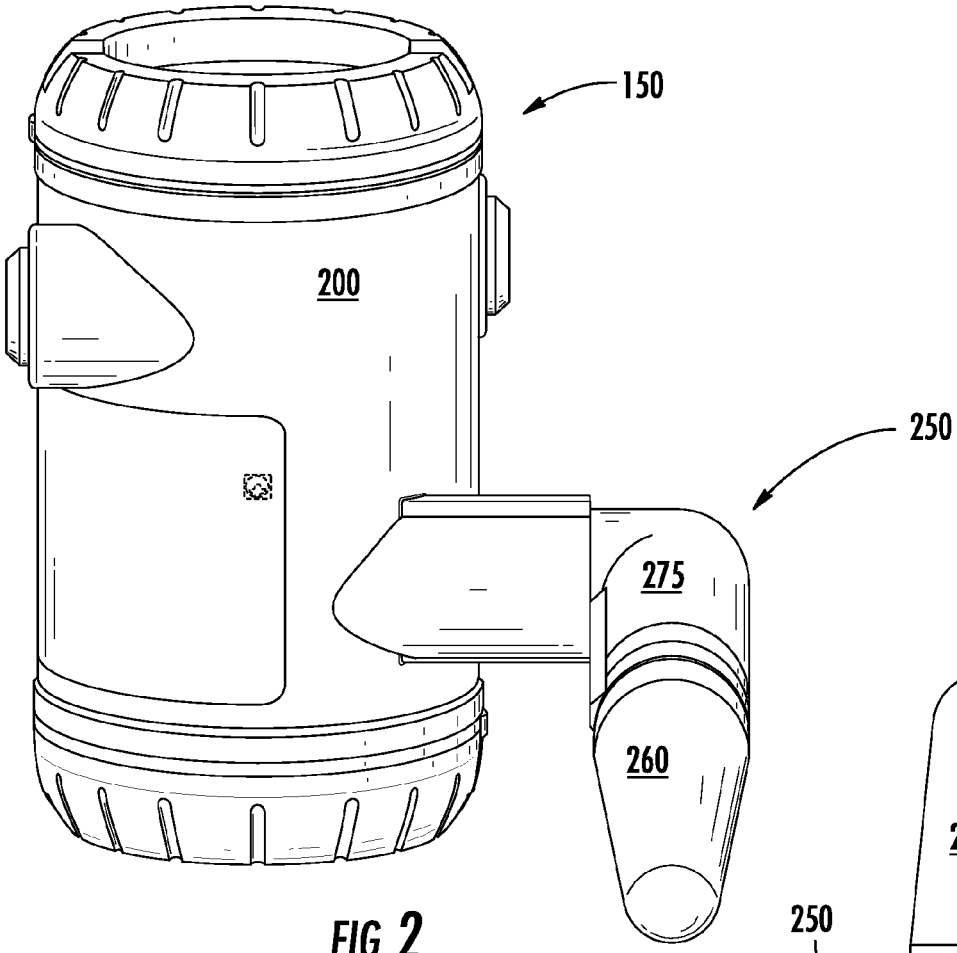
FIG. 2 is a perspective view of the wireless device of the system of FIG. 1.
Figure 3:
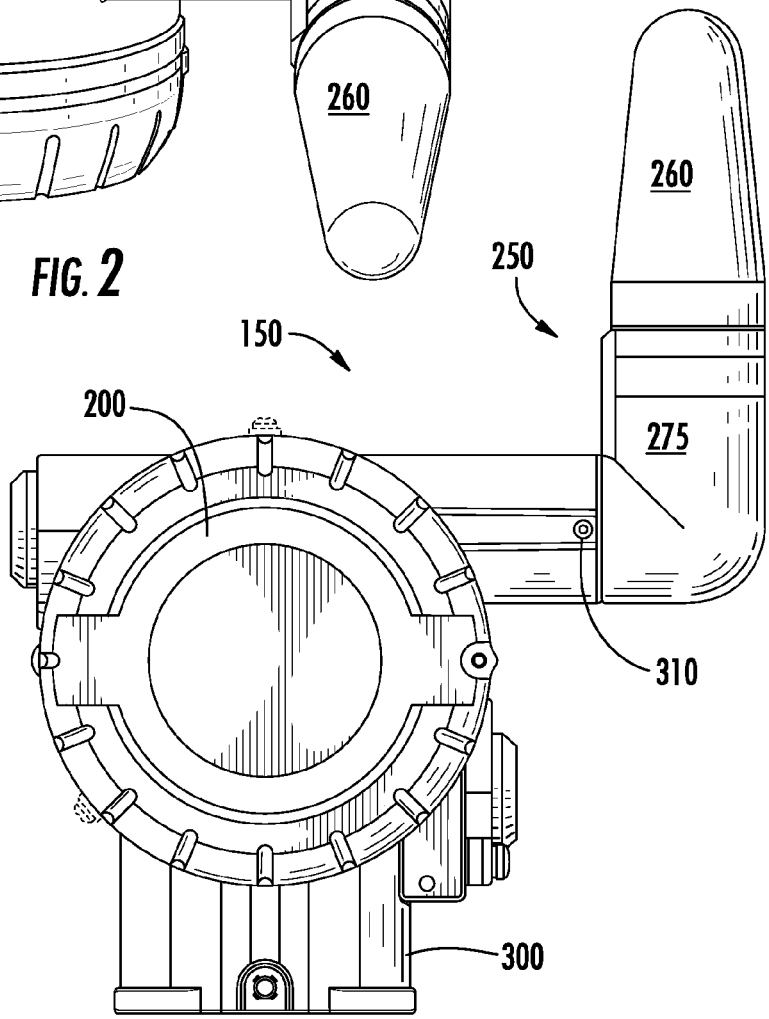
FIG. 3 is a plan view of the wireless device of FIG. 2.

Referring to the drawings, and in particular to FIG. 1, a control system is shown and generally represented by reference numeral 10. Control system 10 can be used with various processing facilities and various processes, such as manufacturing processes, chemical plants and oil refineries. The particular type of facility and the particular type of process that is to be controlled is not intended to be limited. Control system 10 can provide for control of a multi-variable process. In one embodiment, the control system 10 can be applied to a non-linear process, but the present disclosure also contemplates the use of the control system for implementing control in linear processes.

The control system 10 can include a controller 15 that makes use of computing technology, such as a desktop computer or scalable server, for controlling operations of the control system with respect to one or more process facilities 125 (only one shown). The controller 15 can allow for operator access to the control system 10, including operator intervention when desired. The system 10 can also include a communications interface 20 that utilizes common technology for communicating, such as over a network 75, with a server 100. The control system 10 can further include a memory 25 (such as a high capacity storage medium) embodied in this illustration as a database. The network 75 can be various types and combinations of networks, such as wired and/or wireless networks, including a Local Area Network (LAN). The server 100 can be a client's device, such as a customer premises device, having a wireless communications device 110 (e.g. transmitter, receiver, or transceiver) allowing wireless communication with one or more wireless devices according to embodiments of the invention 150 comprising transmitters, receivers or transceivers of the process facility 125 using various wireless protocols, such as Radio Frequency (RF) transmissions, Infra-Red (IR) transmissions, Wireless Fidelity (WiFi), Worldwide Interoperability for Microwave Access (WiMAX), Ultra Wide Band (UWB), software defined radio (SDR), cellular access technologies including CDMA-1X, W-CDMA/HSDPA, UMTS, GSM/GPRS, TDMA/EDGE, FDMA, DSSS, FHSS and EVDO, and cordless phone technology (e.g., DECT), BLUETOOTH™ adjustable antenna feature Embodied as a transmitter, wireless device 150 can be used to transmit sensor data from a sensing device 140 to a remotely located receiver. Embodied as a receiver, wireless device 150 can be used to receive data from a remote transmitting device, for example wireless communications device 110, such as for reconfiguring or providing other data to the sensor. Embodied as a transceiver, wireless device 150 can be used to transmit sensor data to a remotely located receiver and receive data from a remotely located transmitting device, such as wireless communications device 110. As such, the adjustable antenna feature can be used to increase not only the transmitted signal strength (at some remote receiver), but also the received signal strength proximate to the process sensor.

The present disclosure contemplates other configurations for the control system 10, including other configurations of the controller 15, server 100 and wireless devices 150, such as having a plurality of one or more of these components or incorporating each of these components into a single facility. In one embodiment, the wireless devices 150 comprise one or more transmitters 150 that can directly transmit the data wirelessly to the controller 15 and the communications interface 30, without the need for the server 100 of network 75.

In one embodiment, the control system 10 can operate as a distributed control system (DCS) conforming in part to protocols defined by standards bodies, such as the OPC. In another embodiment, the controller 15 can operate utilizing a broad range of client, server and redundancy OPC technologies.

In yet another embodiment, the controller 15 can include an EXPERION™ Process Knowledge System (PKS) that utilizes OPC standards to provide data from the data source and communicates the data to any client application in a standard way, thereby eliminating the requirement for an application to have specific knowledge about a particular data source, such as its internal structure and communications protocols.

In one embodiment, the wireless device 150 can be coupled to one or more sensors 140 for detecting various process parameters, such as temperature, pressure, corrosion, density, sample composition, and so forth. The particular parameter being monitored and the particular data being transmitted is not intended to be limited by the present disclosure. In another embodiment, the one or more sensors 140 can be incorporated into the wireless device 150 to provide an integral unit.

Referring additionally to FIGS. 2-6, wireless device 150 is shown in more detail. The wireless device 150 is generally described below as being a transmitter or transceiver. However, as described above, wireless device 150 can also be a receiver. Embodied as a transmitter or transceiver, wireless device 150 comprises a housing 200 having various associated components therein (not shown) for receiving signals from the sensor, for generating those signals into transmittable data signals, and for transmitting the data signals to a wireless device 110 including a_receiver, such as associated with_server 100 or controller 15 and/or communications interface 30 (not shown). Such transmitting components can include amplifiers, AD converters, modulators and the like, and can vary depending on the particular wireless technology being employed for transmitting the data. The housing 200 can include a base or mounting structure 300 that allows the wireless device 150 to be rigidly connected to a device or other structure at processing facility 125, such as through bolts, welding and the like.

Figure 4:
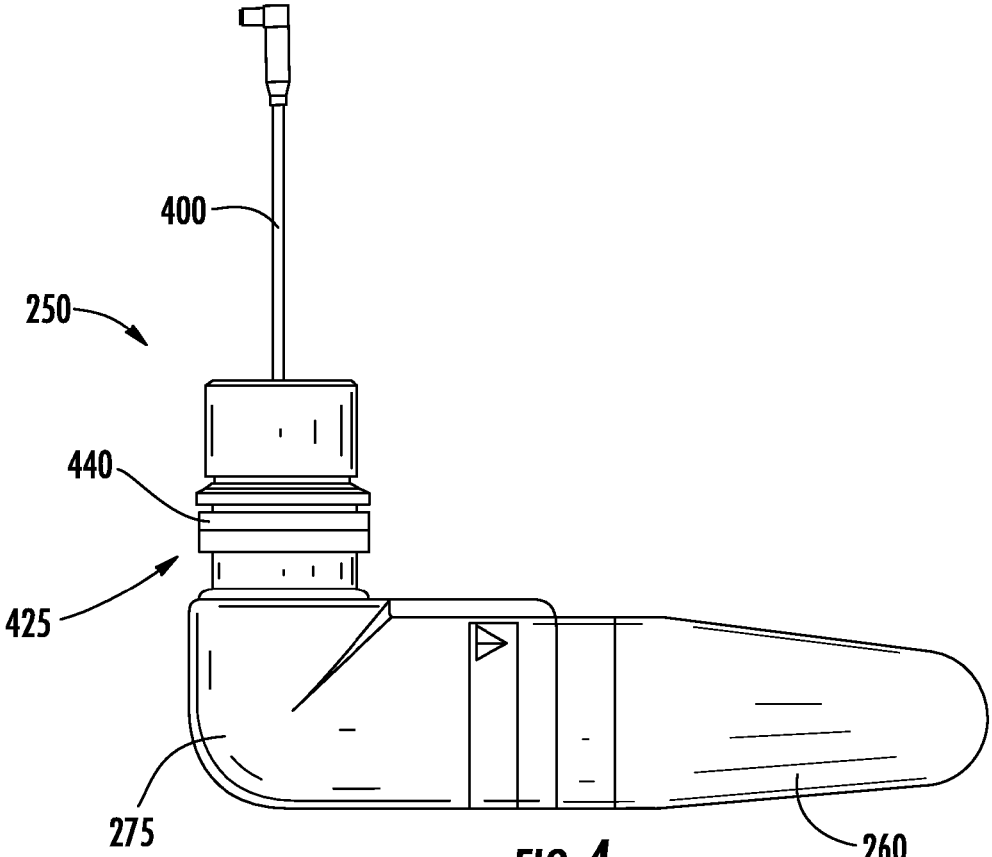
FIG. 4 is a plan view of the antenna assembly of the wireless device of FIG. 2.
Figure 5:
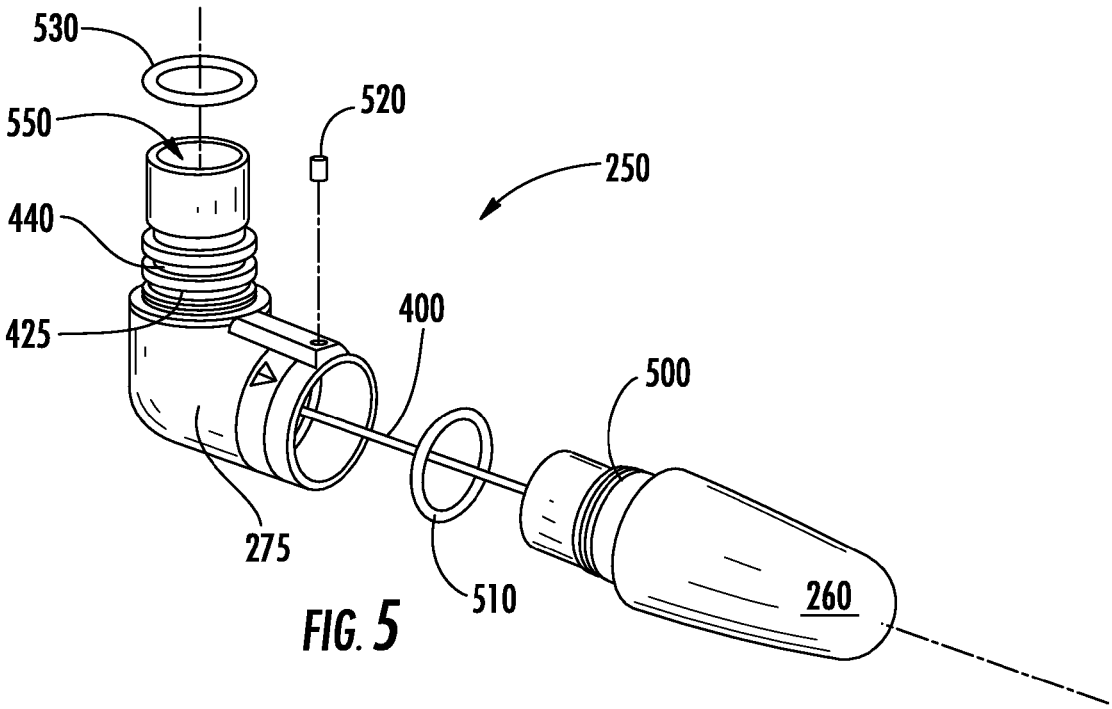
FIG. 5 is an exploded perspective view of the antenna assembly of FIG. 4.
Figure 6:
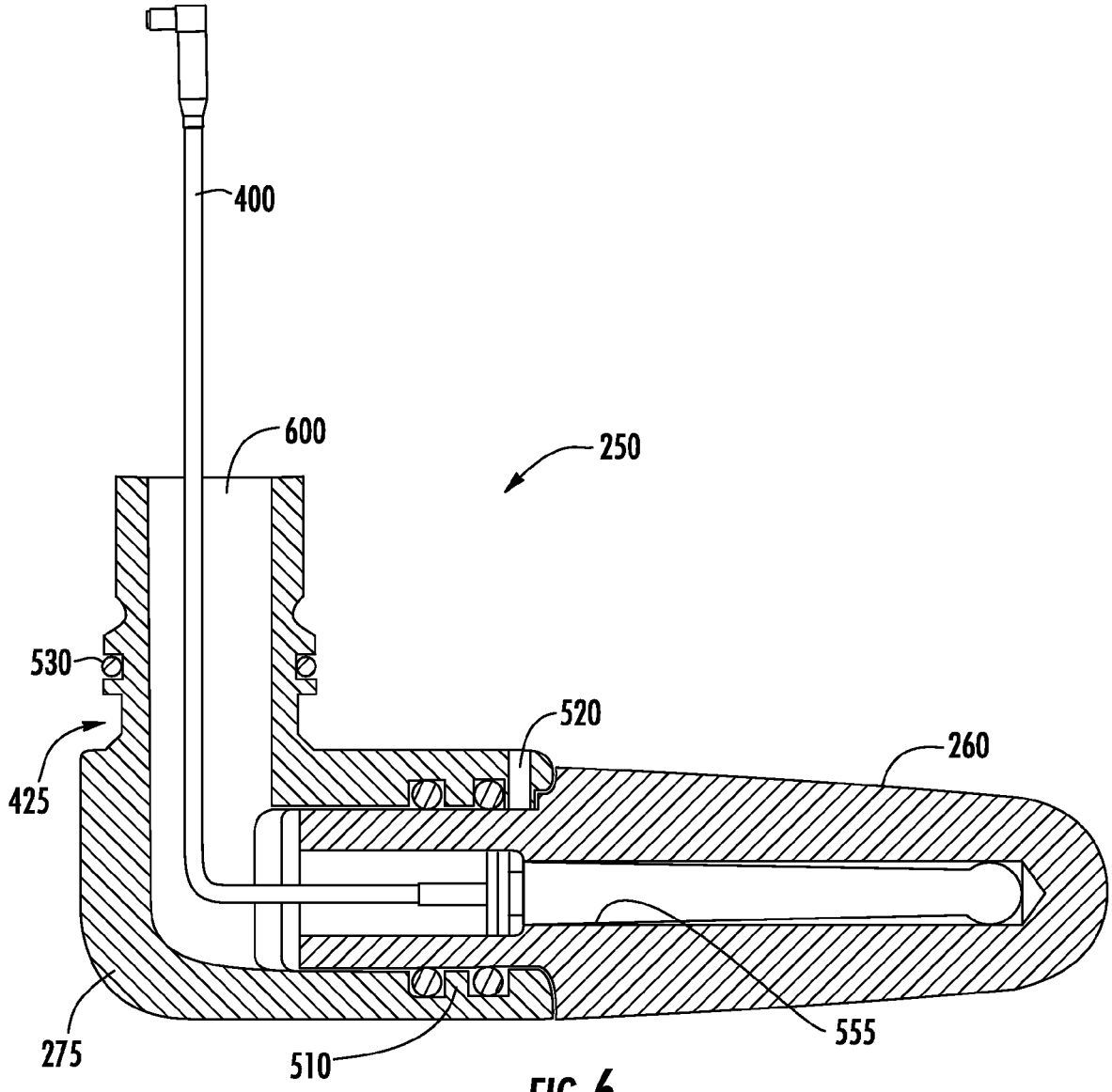
FIG. 6 is a cross-sectional view of the antenna assembly of FIG. 4.
Figure 7:
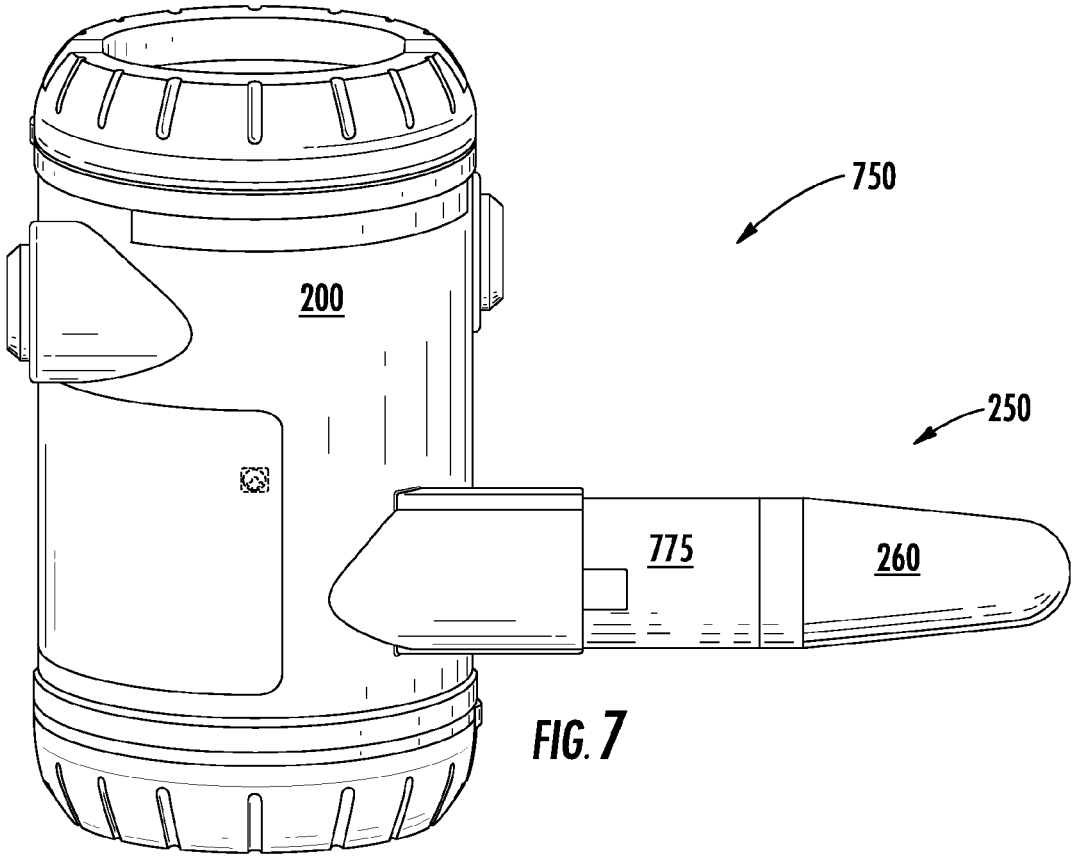
FIG. 7 is a perspective view of another exemplary embodiment of a wireless device that can be used with the system of FIG. 1.
Figure 8:
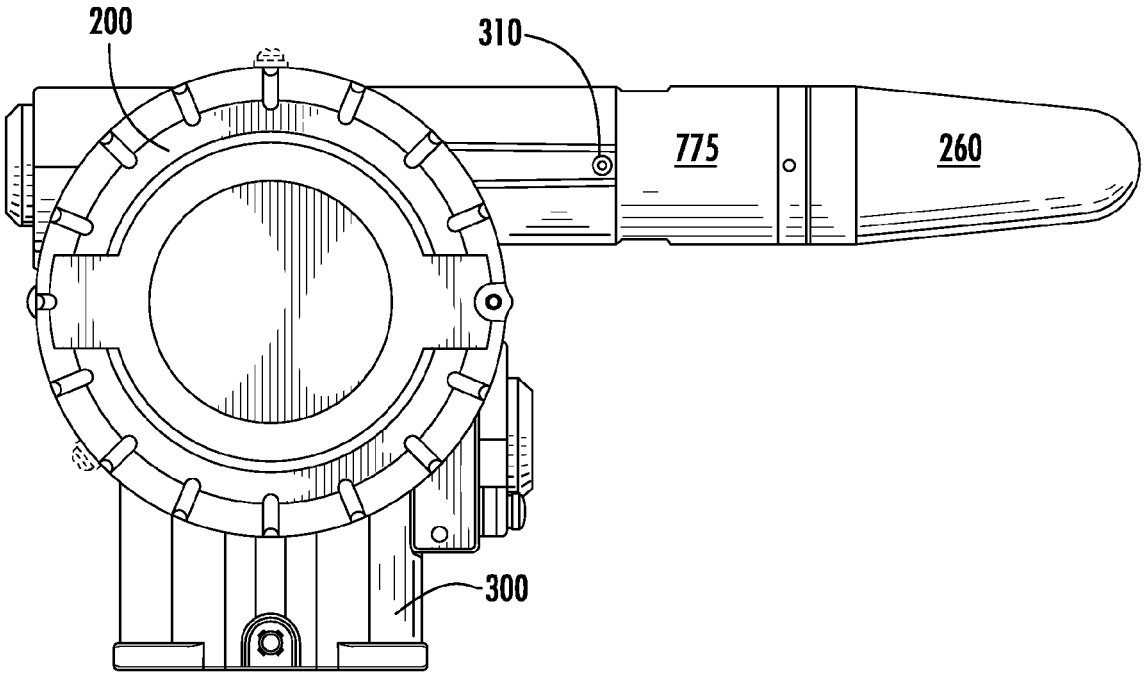
FIG. 8 is a plan view of the wireless device of FIG. 7.
Figure 9:
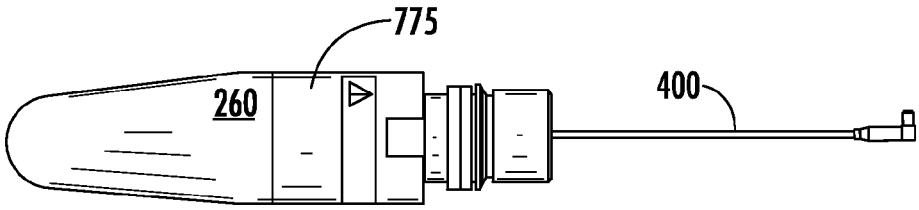
FIG. 9 is a plan view of the antenna assembly of the wireless device of FIG. 7.
Figure 10:
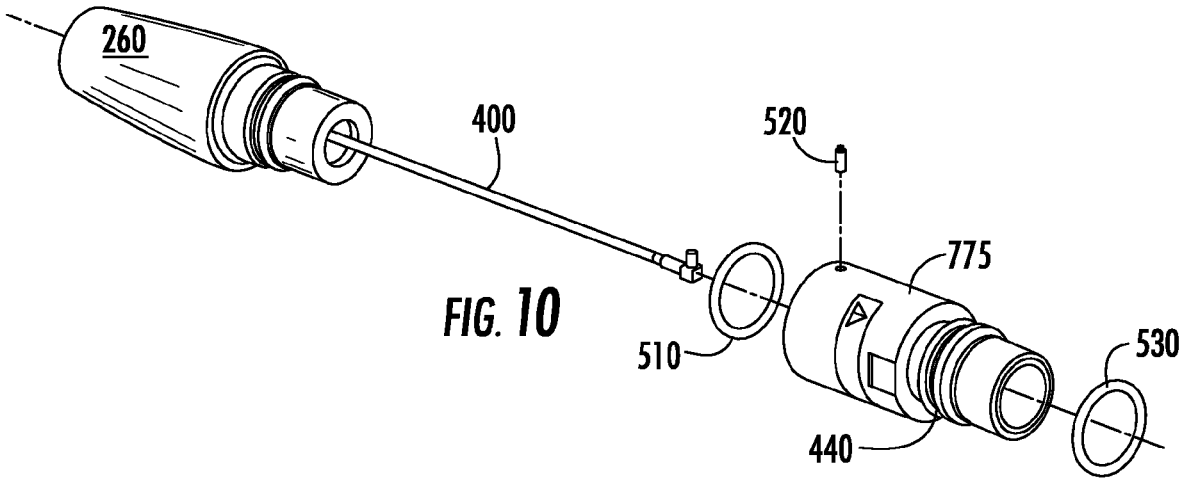
FIG. 10 is an exploded perspective view of the antenna assembly of FIG. 9.
Figure 11:
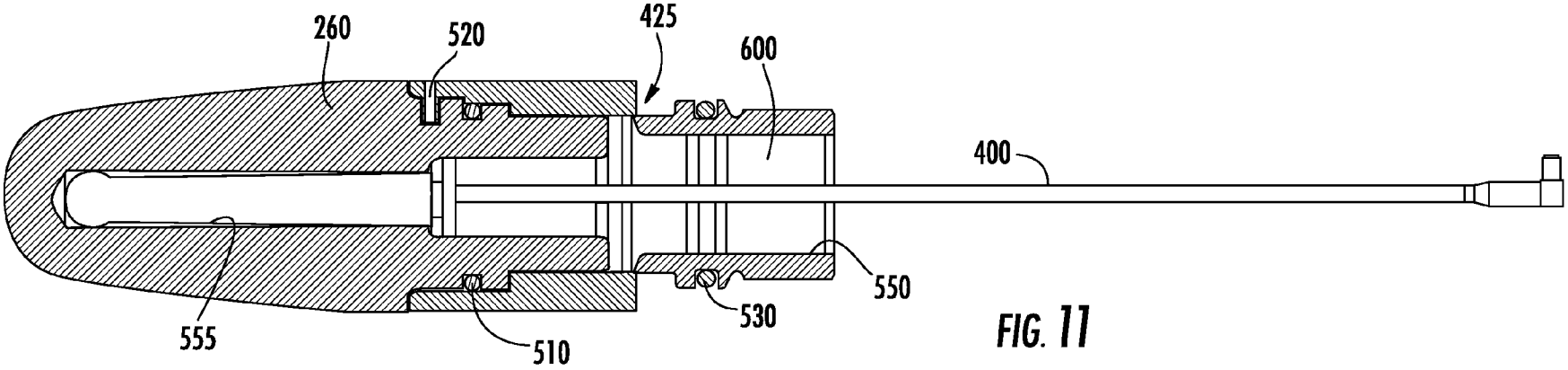
FIG. 11 is a cross-sectional view of the antenna assembly of FIG. 9.
Figure 12:
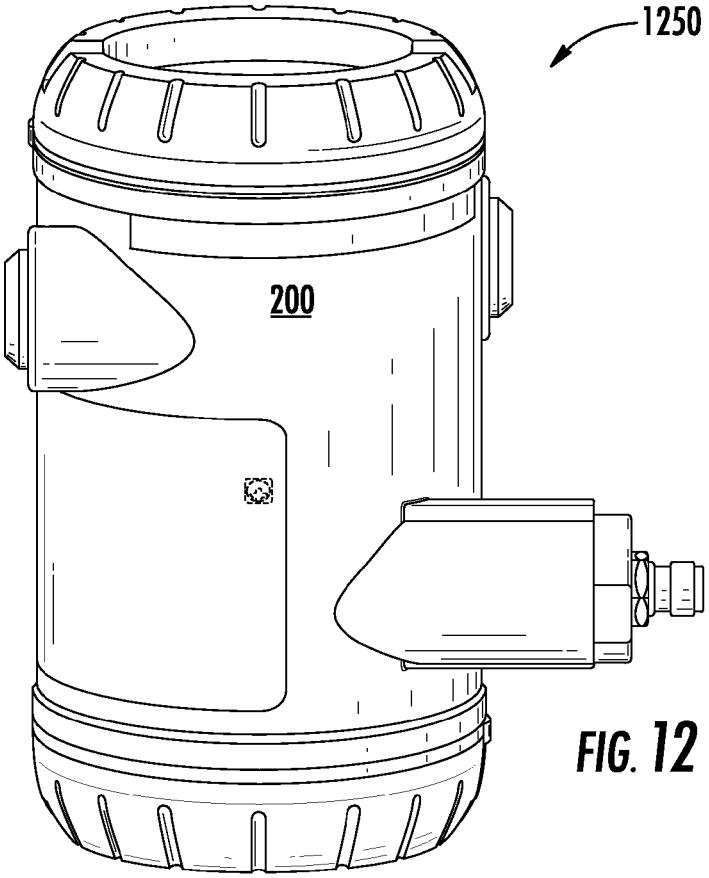
FIG. 12 is a perspective view of another exemplary embodiment of a wireless device that can be used with the system of FIG. 1.
Figure 13:
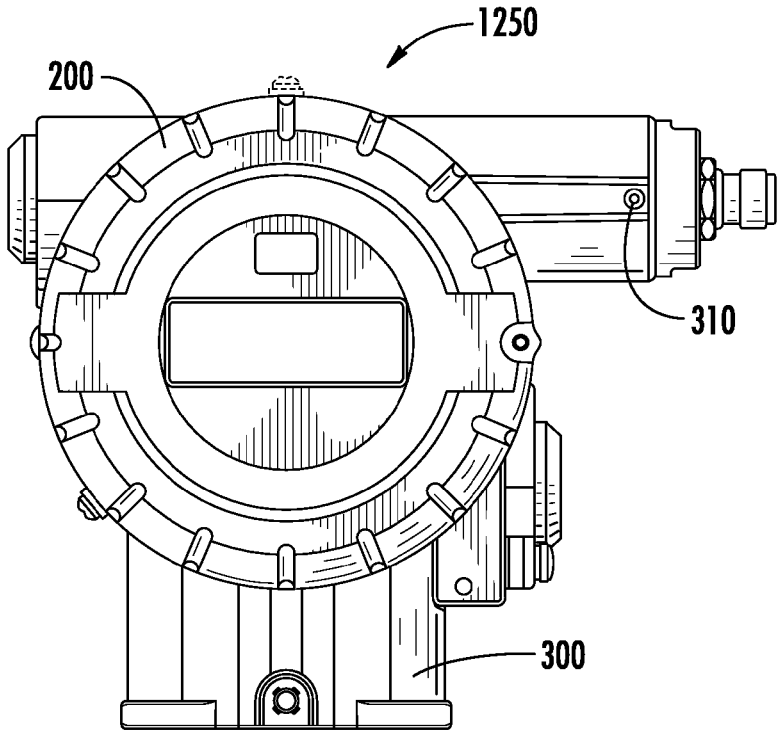
FIG. 13 is a plan view of the wireless device of FIG. 12.
Figure 14:
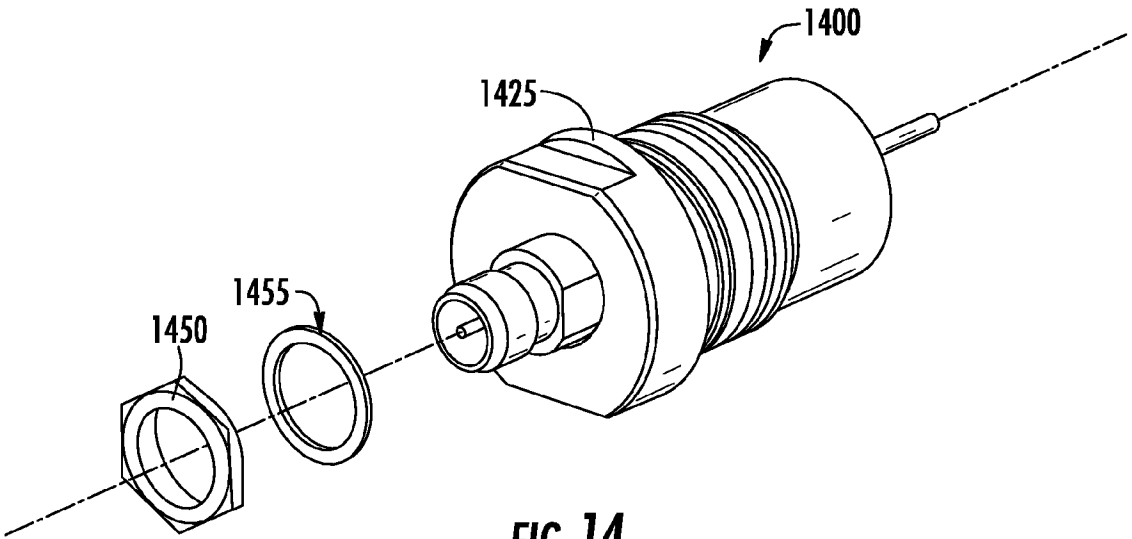
FIG. 14 is a partially exploded view of the antenna assembly of the wireless device of FIG. 12.
Figure 15:
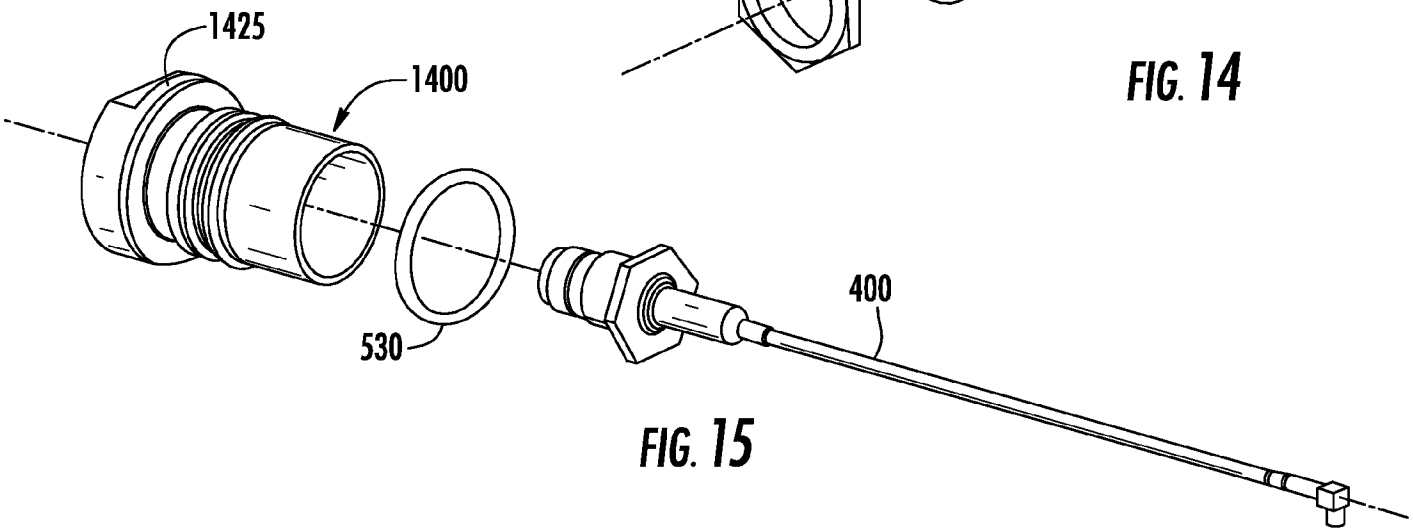
FIG. 15 is an exploded perspective view of the antenna assembly of FIG. 14.
Figure 16:
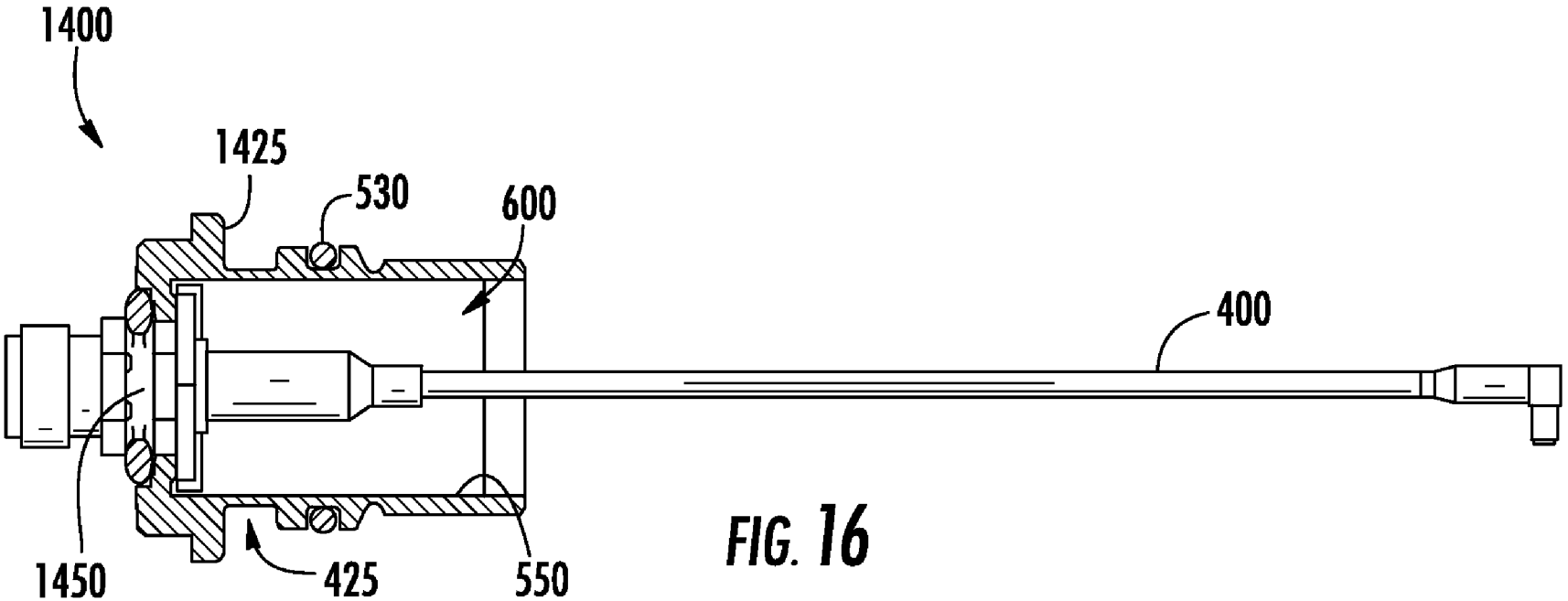
FIG. 16 is a cross-sectional view of the antenna assembly of FIG. 14.

Referring to FIG. 4, the transmitting or receiving components associated with housing 200 can include an antenna cable 400 that extends from the housing into the antenna assembly 250. In one embodiment, the antenna assembly can have an antenna housing 260 and an antenna elbow 275. As shown in FIG. 5, the antenna cable 400 can pass through openings 550 and 555 formed through the elbow 275 and the antenna housing 260.

The housing 200 can be connected to the elbow 275 by a rotatable connection (e.g., a press-fit) using a locking mechanism to maintain the connection. In another embodiment, a threaded connection can be used between the housing 200 and the elbow 275, such as in combination with the locking mechanism, so that the antenna assembly 250 can rotate but not be pulled out of its connection with the housing 200.

The locking mechanism of wireless device 150 can allow for positioning of the antenna assembly 250 with respect to the housing 200. In one embodiment, the locking mechanism can be a set screw 310 that engages with a channel 425 formed about a portion of the circumference of the elbow 275 or about the entire circumference of the elbow. The set screw 310 can be tightened during assembly of the housing 200 with the elbow 275 so that the antenna assembly 250 maintains a desired position with respect to the housing 200.

The set screw 310 and channel 425 can provide for a selectively rotatable connection between the housing 200 and the elbow 275. The set screw 310 can be loosened so that the antenna assembly 250 rotates with respect to the housing 200, while being guided by the set screw that is traveling along the channel 425. The width or length of the channel 425 can dictate the amount of rotation of the antenna assembly 250 with respect to the housing 200. For example, a channel 425 that circumscribes the entire elbow 275 but with a width only slightly larger than the diameter of the set screw 310, may limit rotation of the antenna assembly 250 with respect to the housing 200 to approximately 360° due to contact of the set screw with the sidewalls of the channel. As another example, a channel 425 that circumscribes only half of the elbow 275 would allow for 180° rotation of the antenna assembly 250 with respect to the housing 200, and would prevent further rotation due to contact of the set screw with the ends of the channel. In one embodiment, the width of the channel 425 can be only slightly larger than the diameter of the set screw 310 so that the set screw can travel along the channel while reducing play between the elbow 275 and the housing 200.

The present disclosure contemplates the use of other structures and techniques for the locking mechanism that can selectively limit the movement of the antenna assembly 250 with respect to the housing 200. For example, a biased finger or other projection can be positioned in the channel 425 and can be pulled away from the bottom of the channel against the biasing mechanism (e.g., a spring) to allow for limited rotation of the antenna assembly 250 with respect to the housing 200.

A sealing structure, such as o-ring 530 or another gasket, can be positioned with respect to the connection of the housing 200 and the elbow 275. The o-ring 530 can be positioned along a circumferential groove 440 formed in the elbow 275. Lubricants (e.g., silicone grease) and/or sealing materials may be applied at this connection to maintain a hermetic seal for the housing 200.

The antenna housing 260 can be connected to the elbow 275 by threads 500 that engage with corresponding threads (not shown) of the elbow 275, although other connection structures are also contemplated, such as a lug or ratchet connection. To strengthen the connection, adhesive (e.g., an epoxy adhesive) can be applied over the threads 500. In one embodiment, the connection between the antenna housing 260 and the elbow 275 can be a press-fit that utilizes adhesive or the like to maintain a rigid connection between the two. A set screw 520 can be used to facilitate assembly and/or strengthen the connection between the antenna housing 260 and the elbow 275. In another embodiment, the connection between the antenna housing 260 and the elbow 275 can be a selectively rotatable connection, such as the connection described-above with respect to the housing 200 and the elbow 275. For example, the threads 500 can be used to connect the antenna housing 260 and elbow 275 without the use of any adhesive, and the set screw 520 can engage with a channel (now shown) circumscribing a portion of the antenna housing 260 to allow for limited rotation of the antenna housing.

A sealing structure, such as o-ring 510 or another gasket, can be positioned with respect to the connection of the antenna housing 260 and the elbow 275. Lubricants (e.g., silicone grease) and/or sealing materials may be applied at this connection to maintain a hermetic seal for the antenna assembly 250.

In one embodiment, potting compound 600 can be inserted into openings 550 and 555 to insulate and protect the antenna cable 400, as well as hold it in place with respect to the antenna housing 260 and elbow 275. Various other materials can also be positioned in the openings 550 and 555, including a curing agent for the potting compound.

The use of the locking mechanism (e.g., set screw 310 and channel 425) and the sealing structure (e.g., o-rings 510 and 530) with a selectively rotatable antenna assembly 250 can provide for increasing signal strength between the transmitter 150 and the server 100 (or other receiver) for a given transmitted power, while maintaining both the hermetical seal and explosion-proof flame path of the wireless device 150, including during the movement of the antenna assembly. The housing 200 and antenna assembly 250 can be made from various materials that allow for a hermetical seal and an explosion-proof flame path, including aluminum and/or stainless steel.

Referring to FIGS. 7-11, where similar features are labeled by the same reference numerals as in FIGS. 2-6, another exemplary wireless device is shown and generally referred to as reference numeral 750. Similar to the wireless device 150 described above, data can be transmitted by wireless device 750 embodied as a transmitter or transceiver using various components (not shown) enclosed in housing 200, where those components can receive signals from the sensor, generate those signals into transmittable data signals, and transmit the data signals to a receiver such as wireless device 110 associated with server 100. The housing 200 can include the base 300 that allows the wireless device 750 to be connected to a processing facility device or other structure, such as through bolts, welding and the like.

Embodied as a transmitter or transceiver the transmitting components associated with housing 200 can include the antenna cable 400 that extends from the housing into the antenna assembly 250, which includes the antenna housing 260 and an antenna sleeve 775, and can pass through openings 550 and 555 formed through the sleeve and the antenna housing. The housing 200 can be connected to the sleeve 775 by a rotatable press-fit connection using a locking mechanism to maintain the connection. In another embodiment, a threaded connection can be used between the housing 200 and the sleeve 775, such as in combination with the locking mechanism, so that the antenna assembly 250 can rotate but not be pulled out of its connection with the housing.

The locking mechanism of transmitter 750 can allow for rotation of the antenna assembly 250 with respect to the housing 200. In one embodiment, the locking mechanism can be a set screw 310 that can engage with the channel 425 that is formed about a portion of the circumference of the sleeve 775 or about the entire circumference of the sleeve. The set screw 310 can be tightened during assembly of the housing 200 with the sleeve 775 so that the antenna assembly 250 maintains a desired orientation with respect to the housing 200.

The set screw 310 and channel 425 can provide for a selectively rotatable connection between the housing 200 and the sleeve 775. The set screw 310 can be loosened so that the antenna assembly 250 rotates with respect to the housing 200, while the set screw guides the rotation by traveling along the channel 425. The width or length of the channel 425 can dictate the amount of rotation of the antenna assembly 250 with respect to the housing 200. For example, a channel 425 that circumscribes the entire sleeve 775 but with a width only slightly larger than the diameter of the set screw 310, may limit rotation of the antenna assembly 250 with respect to the housing 200 to approximately 360° due to contact of the set screw with the sidewalls of the channel. As another example, a channel 425 that circumscribes only half of the sleeve 775 would allow for 180° rotation of the antenna assembly 250 with respect to the housing 200, and would prevent further rotation due to contact of the set screw with the ends of the channel. In one embodiment, the width of the channel 425 can be only slightly larger than the diameter of the set screw 310 so that the set screw can travel along the channel while reducing play between the sleeve 775 and the housing 200.

A sealing structure, such as o-ring 530 or another gasket, can be positioned with respect to the connection of the housing 200 and the sleeve 775. The o-ring 530 can be positioned along a circumferential groove 440 formed in the sleeve 775. Lubricants (e.g., silicone grease) and/or sealing materials may be applied at this connection to maintain a hermetic seal for the housing 200.

The antenna housing 260 can be connected to the sleeve 775 by threads that engage with corresponding threads (not shown) of the sleeve 775, although other connection structures are also contemplated, including a lug or ratchet connection. To strengthen the connection, adhesive (e.g., an epoxy adhesive) can be applied over the threads 500. In one embodiment, the connection between the antenna housing 260 and the sleeve 775 can be a press-fit that utilizes adhesive or the like to maintain a rigid connection between the two. In another embodiment, the connection between the antenna housing 260 and the sleeve 775 can be a selectively rotatable connection, such as the connection described-above with respect to the housing 200 and the sleeve 775. For example, the threads 500 can be used to connect the antenna housing 260 and sleeve 775 without the use of any adhesive, and the set screw 520 can engage with a channel (now shown) circumscribing a portion of the antenna housing 260 to allow for limited rotation of the antenna housing.

A sealing structure, such as o-ring 510 or another gasket, can be positioned with respect to the connection of the antenna housing 260 and the sleeve 775. Lubricants (e.g., silicone grease) and/or sealing materials may be applied at this connection to maintain a hermetic seal for the antenna assembly 250.

In one embodiment, potting compound 600 can be inserted into openings 550 and 555 to insulate and protect the antenna cable 400, as well as hold it in place with respect to the antenna housing 260 and sleeve 775. Various other materials can also be positioned in the openings 550 and 555, including a curing agent.

The use of the locking mechanism (e.g., set screw 310 and channel 425) and the sealing structure (e.g., o-rings 510 and 530) with a selectively rotatable antenna assembly 250 can provide for increasing signal strength between the transmitter 750 and the server 100 (or other receiver) for a given transmitted power, while maintaining both the hermetical seal and explosion-proof flame path of the transmitter 750. This can be useful where the antenna assembly 250 is not omni-directional. The housing 200 and antenna assembly 250 can be made from various materials that allow for a hermetical seal and an explosion-proof flame path, including aluminum and/or stainless steel.

Referring to FIGS. 12-16, where similar features are labeled by the same reference numerals as in FIGS. 2-6, another exemplary wireless device is shown and generally referred to as reference numeral 1250. Similar to the wireless device 150 described above, embodied as a transceiver or transmitter data can be transmitted by the wireless device 1250 using various components (not shown) enclosed in housing 200, where those components can receive signals from the sensor, generate those signals into transmittable data signals, and transmit the data signals to a receiver such as wireless device 110 associated with server 100. The housing 200 can include the base 300 that allows the wireless device 1250 to be connected to a processing facility device or other structure, such as through bolts, welding and the like.

Embodied as a transceiver or transmitter, the transmitting components associated with housing 200 can include the antenna cable 400 that extends from the housing into an antenna adapter 1400, and can pass through opening 550 formed through the antenna adapter. The housing 200 can be connected to the antenna adapter 1400 by a rotatable press-fit connection. In one embodiment, the adapter 1400 can have a flange 1425 that can be seated with the housing 200. The connection between the housing 200 and the adapter 1400 can include a locking mechanism. In another embodiment, a threaded connection can be used between the housing 200 and the antenna adapter 1400, so that the antenna adapter can rotate but not be pulled out of the connection with the housing.

The locking mechanism of transmitter 1250 can allow for rotation of the antenna adapter 1400 with respect to the housing 200. In one embodiment, the locking mechanism can be a set screw 310 that engages with a channel 425 that is formed about a portion of the circumference of the adapter 1400 or about the entire circumference of the adapter. The set screw 310 can be tightened during assembly of the housing 200 with the adapter 1400 so that the adapter maintains a desired orientation with respect to the housing 200.

The set screw 310 and channel 425 can provide for a selectively rotatable connection between the housing 200 and the adapter 1400. The set screw 310 can be loosened so that the adapter 1400 rotates with respect to the housing 200, while the set screw travels along the channel 425. The width or length of the channel 425 can dictate the amount of rotation of the adapter 1400 with respect to the housing 200. For example, a channel 425 that circumscribes the entire adapter 1400 but with a width only slightly larger than the diameter of the set screw 310, may limit rotation of the adapter 1400 with respect to the housing 200 to approximately 360° due to contact of the set screw with the sidewalls of the channel. As another example, a channel 425 that circumscribes only half of the adapter 1400 would allow for 180° rotation of the adapter 1400 with respect to the housing 200, and would prevent further rotation due to contact of the set screw with the ends of the channel. In one embodiment, the width of the channel 425 can be only slightly larger than the diameter of the set screw 310 so that the set screw can travel along the channel while reducing play between the adapter 1400 and the housing 200.

A sealing structure, such as o-ring 530 or another gasket, can be positioned with respect to the connection of the housing 200 and the adapter 1400. The o-ring 530 can be positioned along a circumferential groove 440 formed in the adapter 1400. Lubricants (e.g., silicone grease) and/or sealing materials may be applied at this connection to maintain a hermetic seal for the housing 200.

The antenna adapter 1400 can have a locknut 1450 and a lockwasher 1455. The locknut 1450 and lockwasher 1455 can hold the antenna cable 400 in position with respect to the antenna adapter 1400 and the housing 200. The antenna adapter 1400 can allow for connection of other antenna housings, such as those described above with respect to wireless devices 150 and 750.

In one embodiment, potting compound 600 can be inserted into the opening 550 to insulate and protect the antenna cable 400, as well as hold it in place with respect to the antenna adapter 1400. Various other materials can also be positioned in the opening 550, including a curing agent.

The use of the locking mechanism (e.g., set screw 310 and channel 425) and the sealing structure (e.g., o-ring 530) with a selectively rotatable antenna adapter 1400 can provide for increasing signal strength between the transmitter 1250 and the server 100 (or other receiver), while maintaining both the hermetical seal and explosion-proof flame path of the wireless device 1250. The housing 200 and antenna adapter 1400 can be made from various materials that allow for a hermetical seal and an explosion-proof flame path, including aluminum and/or stainless steel.

Figure 17:
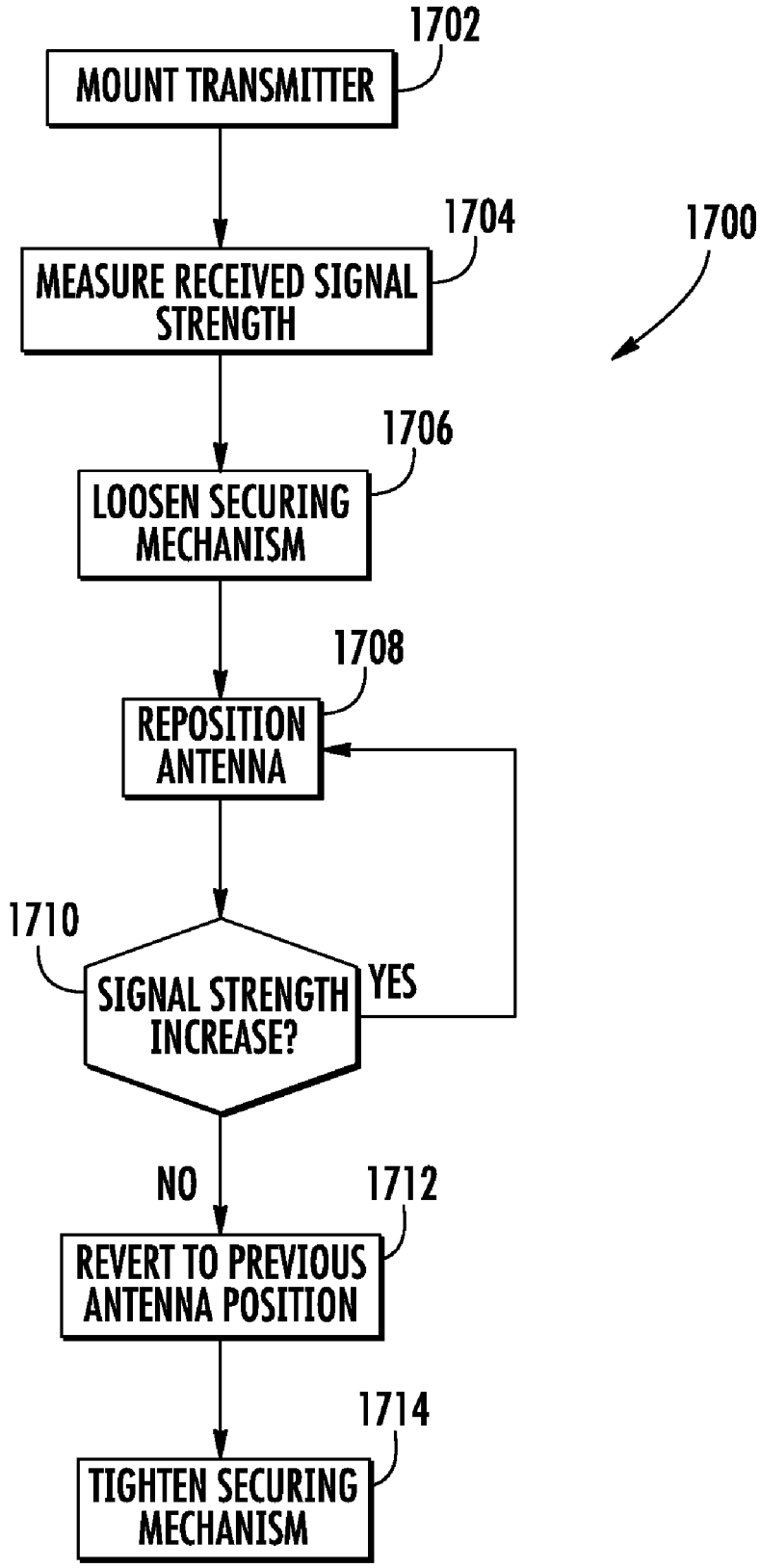
FIG. 17 is a flow chart illustrating an exemplary method for monitoring a process according to an exemplary embodiment of the present invention using the system and/or devices of FIGS. 1 through 16.

FIG. 17 depicts an exemplary method 1700 operating in portions of the monitoring system 10. It would be apparent to an artisan with ordinary skill in the art that other embodiments not depicted in FIG. 17 are possible without departing from the scope of the claims described below. Method 1700 is described with reference to the wireless device 150 embodied as a transmitter or transceiver, but the present disclosure contemplates the use of any of the transmitters or transceivers described herein or otherwise usable with system 10 for remotely monitoring parameters of the process or sample of facility 125. Moreover, as described above, methods according to the invention can include receiving data.

Method 1700 begins with step 1702 in which the wireless transmitter or transceiver 150 is mounted or otherwise positioned with respect to the device or sample that is to be monitored or with respect to the sensor 140 retrieving the process parameters that are to be transmitted. The mounting can be by done through various structures and techniques, including bolting or welding the base 300 of the wireless transmitter or transceiver 150 to the process device to form a rigid connection. However, the present disclosure also contemplates the wireless transmitter or transceiver 150 being connected with respect to the device to be monitored in a non-rigid manner, such as a rotatable or slideable connection.

In step 1704, the wireless transmitter or transceiver 150 is actuated and the signal strength of the transmitted signal is measured. The signal strength can be measured at a remotely located controller, such as a wireless communications device associated with_controller 15 shown in FIG. 1, or some other receiver. In step 1706, the securing mechanism, such as set screw 310 (and channel 425), is loosened to allow for movement of the antenna assembly 250 with respect to the housing 200 of the wireless transmitter or transceiver 150. The movement can include rotation of the antenna housing 260 or movement of the antenna assembly 250 (e.g., through use of elbow 275). The antenna assembly 250 can then be repositioned with respect to the housing 200 of the wireless transmitter or transceiver 150 in step 1708 and a determination of received signal strength at the remotely located receiver can be made in step 1710.

If the signal strength is improved with the repositioning then method 1700 can continue to try to find a position of the antenna assembly 250 with respect to the housing 200 that provides for the highest received signal strength. If there is no further increase in signal strength then in step 1712, method 1700 can revert to the position of the antenna assembly corresponding to the previous highest signal strength. In step 1714, the securing mechanism, such as set screw 310, can be tightened. Method 1700 can be periodically performed to maintain a desired signal strength. Additionally, certain events can trigger performance of method 1700, such as changes to the configuration of the processing facility or the signal strength falling below a desired threshold.

The present disclosure also contemplates the use of a computer system within which a set of instructions, when executed, may cause the machine to perform any one or more of the methodologies discussed above. The computer instructions can be embodied in a storage medium. In some embodiments, the machine operates as a standalone device. In some embodiments, the machine may be connected (e.g., using a network) to other machines. In a networked deployment, the machine may operate in the capacity of a server or a client user machine in server-client user network environment, or as a peer machine in a peer-to-peer (or distributed) network environment. The machine may comprise a server computer, a client user computer, a personal computer (PC), a tablet PC, a laptop computer, a desktop computer, a control system, a network router, switch or bridge, or any machine capable of executing a set of instructions (sequential or otherwise) that specify actions to be taken by that machine. Further, the term "machine" shall be taken to include a single machine or any collection of machines that individually or jointly execute a set (or multiple sets) of instructions to perform any one or more of the methodologies discussed herein.

The computer-readable storage medium can have stored thereon one or more sets of instructions (e.g., software) embodying any one or more of the methodologies or functions described herein, including those methods illustrated above. The computer-readable storage medium can be an electromechanical medium such as a common disk drive, or a mass storage medium with no moving parts such as Flash or like non-volatile memories. The instructions may also reside, completely or at least partially, within a main memory, a static memory, and/or within a processor during execution thereof by the computer system. The main memory and the processor also may constitute computer-readable storage media.

Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, the methods described herein are intended for operation as software programs running on a computer processor. Furthermore, software implementations can include, but not limited to, distributed processing or component/object distributed processing, parallel processing, or virtual machine processing can also be constructed to implement the methods described herein. The present disclosure contemplates a machine readable medium containing instructions, or that which receives and executes instructions from a propagated signal so that a device, such as connected to a network environment can send or receive data, and to communicate over the network using the instructions.

While the computer-readable storage medium can be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to: solid-state memories such as a memory card or other package that houses one or more read-only (non-volatile) memories, random access memories, or other re-writable (volatile) memories; magneto-optical or optical medium such as a disk or tape; and carrier wave signals such as a signal embodying computer instructions in a transmission medium; and/or a digital file attachment to e-mail or other self-contained information archive or set of archives is considered a distribution medium equivalent to a tangible storage medium. Accordingly, the disclosure is considered to include any one or more of a computer-readable storage medium or a distribution medium, as listed herein and including art-recognized equivalents and successor media, in which the software implementations herein are stored.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Therefore, it is intended that the disclosure not be limited to the particular embodiment(s) disclosed as the best mode contemplated for carrying out this invention, but that the invention will include all embodiments falling within the scope of the appended claims.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims.

What is claimed is:

1. A wireless device operably coupled to a sensing device that captures data representative of one or more parameters of a process device or sample, the wireless device comprising:

a housing having a mounting structure for rigidly connecting the wireless device with respect to the process device or sample; and an antenna assembly having a movable connection with the housing, wherein the wireless device wirelessly transmits the data using the antenna assembly to a remote receiver or receives information from a remotely located transmitter, wherein the antenna assembly can be moved with respect to the housing, and wherein the movable connection maintains a hermetic seal and an explosion-proof flame path of the housing and the antenna assembly, the antenna assembly having an adapter or elbow with a channel formed along at least a portion of a circumference of the adapter or elbow, wherein the movable connection comprises a set screw, the channel and a sealing structure, and wherein the set screw travels along the channel to guide movement of the antenna assembly with respect to the housing.

2. The wireless device of claim 1, wherein the channel has a width, and wherein the width limits the amount of movement of the antenna assembly with respect to the housing.

3. The wireless device of claim 1, wherein the channel only partially circumscribes the adapter and has a length, and wherein the length limits the amount of movement of the antenna assembly with respect to the housing.

4. The wireless device of claim 1, wherein the movable connection comprises threads and a locking mechanism, and wherein the locking mechanism limits movement of the elbow with respect to the housing along the threads.

5. The wireless device of claim 4, wherein the antenna assembly has an opening therethrough, and wherein a potting compound is positioned in the opening.

6. The wireless device of claim 1, wherein the antenna assembly has antenna housing, wherein, wherein the movable connection comprises the set screw, the channel and a first o-ring, wherein the set screw travels along the channel to guide movement of the adapter with respect to the housing, wherein the antenna housing has a second o-ring, and wherein the adapter is connected to the antenna housing with threads.

7. The wireless device of claim 1, wherein the wireless device comprises a transmitter, receiver or transceiver.

8. A wireless device comprising:

a housing having a mounting structure for rigidly connecting the wireless device with respect to a solid surface, and an antenna assembly having a movable connection with the housing, wherein the antenna assembly can be moved with respect to the housing, and wherein the movable connection maintains a hermetic seal and an explosion-proof flame path of the housing and the antenna assembly, the antenna assembly having an adapter or elbow with a channel formed along at least a portion of a circumference of the adapter or elbow, wherein the movable connection comprises a set screw, the channel and a sealing structure, and wherein the set screw travels along the channel to guide movement of the antenna assembly with respect to the housing, and a transmitter, a receiver or a transceiver coupled to the antenna assembly, wherein the wireless device is operable to wirelessly transmit using the antenna assembly to a remote receiver or receive information from a remotely located transmitter.

9. A wireless monitoring system for a process device or sample, the system comprising:

a sensing device that captures data representative of one or more parameters of the process device or sample;

a wireless transmitter or transceiver operably coupled to the sensing device and having a housing and an antenna assembly, wherein the housing has a mounting structure for connecting the transmitter in proximity to the process device or sample, wherein the antenna assembly has a movable connection with the housing, wherein the antenna assembly can be moved with respect to the housing, and wherein the movable connection maintains a hermetic seal and an explosion-proof flame path of the housing and the antenna assembly, the antenna assembly having an adapter or elbow with a channel formed along at least a portion of a circumference of the adapter or elbow, wherein the movable connection comprises a set screw, the channel and a sealing structure, and wherein the set screw travels along the channel to guide movement of the antenna assembly with respect to the housing; and a receiver remotely positioned from the wireless transmitter or transceiver, wherein the transmitter or transceiver wirelessly transmits the data using the antenna assembly to said receiver.

10. The system of claim 9, wherein the channel has a width and a length, and wherein at least one of the width or length limits the amount of movement of the antenna assembly with respect to the housing.

11. The system of claim 9, wherein the antenna assembly has antenna housing, wherein the movable connection comprises the set screw, the channel and a first o-ring, wherein the set screw travels along the channel to guide movement of the adapter with respect to the housing, wherein the antenna housing has a second o-ring, and wherein the adapter is connected to the antenna housing.

12. A method of monitoring a process device or sample, the method comprising:

providing a wireless transmitter or transceiver having an antenna assembly and a housing, the antenna assembly having a movable connection with the housing and an adapter or elbow with a channel formed along at least a portion of a circumference of the adapter or elbow, wherein the movable connection comprises a set screw, the channel and a sealing structure, and wherein the set screw travels along the channel to guide movement of the antenna assembly with respect to the housing;

adjusting a position of the antenna assembly with respect to the housing using the set screw while maintaining a hermetic seal and an explosion-proof flame path of the housing and the antenna assembly;

after said adjusting, measuring a signal strength of a signal transmitted by the wireless transmitter or transceiver at a receiver remotely located from the wireless transmitter or transceiver, and determining a target position of the antenna assembly with respect to the housing based at least in part on the signal strength.

13. The method of claim 12, further comprising:

capturing data representative of one or more parameters of the process device or sample;

providing the data to the wireless transmitter or transceiver; and transmitting the data to the receiver.

14. The method of claim 13, further comprising limiting the movement of the antenna assembly with respect to the housing using a locking mechanism.

* * * * *